US006091203A

United States Patent [19]

Kawashima et al.

[11] Patent Number: 6,091,203

[45] Date of Patent: Jul. 18, 2000

[54] IMAGE DISPLAY DEVICE WITH ELEMENT DRIVING DEVICE FOR MATRIX DRIVE OF MULTIPLE ACTIVE ELEMENTS

[75] Inventors: Shingo Kawashima; Hiroshi Sasaki, both of Tokyo, Japan

[73] Assignee: NEC Corporation, Tokyo, Japan

[21] Appl. No.: 09/275,889

[22] Filed: Mar. 25, 1999

[30] Foreign Application Priority Data

Mar. 31, 1998 [JP] Japan ..... 10-086578

[51] Int. Cl.[7] ..... G09G 3/10

[52] U.S. Cl. ..... 315/169.3; 345/55; 345/76; 345/211

[58] Field of Search ..... 315/169.3, 169.4, 315/169.2, 169.1, 291, 307, 302; 345/55, 76, 204, 211

[56] References Cited

U.S. PATENT DOCUMENTS

| | | | |
|---|---|---|---|
| 4,006,383 | 2/1977 | Luo et al. | 315/169 TV |
| 4,528,480 | 7/1985 | Unagami et al. | 315/169.1 |
| 4,704,559 | 11/1987 | Suginoya et al. | 315/169.3 |
| 5,153,483 | 10/1992 | Kishino et al. | 315/169.1 |
| 5,552,677 | 9/1996 | Pagones | 345/76 |
| 5,684,365 | 11/1997 | Tang et al. | 345/76 |
| 5,767,823 | 6/1998 | Hush | 345/55 |
| 5,818,406 | 10/1998 | Tsuchi et al. | 345/211 |
| 5,903,248 | 5/1999 | Irwin | 345/211 |
| 5,966,110 | 10/1999 | Van Zalinge | 345/211 |

FOREIGN PATENT DOCUMENTS

| | | | |
|---|---|---|---|
| 5-74569 | 3/1993 | Japan | H05B 33/08 |
| 8-54835 | 2/1996 | Japan | G09F 9/33 |

*Primary Examiner*—Don Wong
*Assistant Examiner*—Thuy Vinh Tran
*Attorney, Agent, or Firm*—Sughrue, Mion, Zinn, Macpeak & Seas, PLLC

[57] ABSTRACT

An image display device has multiple active elements arranged therein, such as an organic EL (Electro-Luminescence) element to matrix-drives these active elements. In the image display device, when a switching element is turned on with a control signal applied to a control electrode, a control current on a signal electrode is converted to a control voltage by a second transistor, held in a holding capacitor, and applied to a gate electrode of a first transistor. Thus, the signal electrode is applied with the control current, not with a control voltage, for controlling the operation of the active element. A drive voltage to be applied to a power supply electrode is converted to a drive current and supplied to the active element.

25 Claims, 9 Drawing Sheets

IMAGE DISPLAY DEVICE WITH ELEMENT DRIVING DEVICE FOR MATRIX DRIVE OF MULTIPLE ACTIVE ELEMENTS

BACKGROUND OF THE INVENTION

1. Field of the Invention

The present invention relates to an element driving device for matrix drive of multiple active elements, and more particularly to an element driving device for driving multiple active elements with a variable drive current.

2. Description of the Related Art

Heretofore, actively operated and controlled elements have been used in various devices. For example, an image display device utilizes a display element such as a light emitting element as an active element. Such light emitting elements include an EL (Electro-Luminescence) element and the like. An EL device includes an inorganic element and an organic element.

Inorganic EL elements have been put into practical use, for example, as back-lights of a liquid crystal displays, because they can realize uniform surface emission with reduced power. On the other hand, organic EL elements have not yet been developed sufficiently and have problems to be solved such as durability. However, there has been a demand for a practical use of organic EL elements because it can be driven with a low voltage direct-current, provides high brightness with a high efficiency, and exhibits a favorable responsibility.

Since the organic EL elements are driven with a current as described above, an element driving device differs in structure from that for a conventional inorganic EL element which is driven with a voltage. For example, Japanese Patent Laid-open Publication No. 54835/1996 discloses an element driving device for driving a light emitting element of current control type on an active matrix scheme.

This element driving device, however, is designed to control gradation of organic EL elements through turning on and off a plurality of transistors. Accordingly, numerous transistors are required for providing representation with multi-level gradation, which is not suitable for practical use.

Also, Japanese Patent Laid-open Publication No. 74569/1993 discloses an element driving device for driving an inorganic EL elements with a voltage. In the element driving device disclosed in the publication, a power supply electrode to which a predetermined drive voltage is to be applied is connected to an inorganic EL element through a TFT (Thin Film Transistor).

The TFT converts a drive voltage to be applied to the power supply electrode to a drive current corresponding to a control voltage to be applied to a gate electrode and supplies the drive current to the inorganic EL element. To control the amount of the current to be supplied, an element for holding a voltage is connected to the gate electrode of the TFT.

The control of emission brightness of the inorganic EL element is effected by controlling the voltage to be held in the element. Therefore, there is no need to increase the number of transistors for the increased number of levels of gradation in element unit as in the device disclosed in the aforementioned Japanese Patent Laid-open Publication No. 54835/1996.

An element driving device, the element driving device the aforementioned structure to the organic EL element which is an active element of current control type, will be hereinafter described with reference to FIG. 1 as one prior art.

An element driving device 1 illustrated by way of example has an organic EL element 2 as an active element and a power supply line 3 and a ground line 4 as a pair of power supply electrodes. A predetermined drive voltage is applied to power supply line 3, and ground line 4 is grounded.

Organic EL element 2 is connected directly to power while supply line 3 is connected to ground line 4 through TFT 5. TFT 5 converts a drive voltage from power supply line 3 to be applied to ground line 4 into a drive current corresponding to a control voltage to be applied to a gate electrode to supply the current to organic EL element 2.

The gate electrode of TFT 5 is connected to holding capacitor 6 for holding a voltage, which is also connected to ground line 4. Holding capacitor 6 and the gate electrode of TFT 5 are connected to signal line 8 serving as a signal electrode through switching element 7. A control terminal of switching element 7 is connected to control line 9 serving as a control electrode.

Holding capacitor 6 holds the control voltage to apply the voltage to the gate electrode of TFT 5. Switching element 7 turns on and off the connection between holding capacitor 6 and signal line 8. Signal line 8 is supplied with the control voltage for driving the emission brightness of organic EL element 2. Control line 9 is applied with a control signal for controlling the operation of switching element 7.

Element driving device 1 with the aforementioned the structure is capable of controlling organic EL element 2 at variable emission brightness, in such a way as to apply a control signal to control line 9 to turn on switching element 7, and with this state maintained, to supply a control voltage corresponding to the emission luminescence of organic EL element 2 from signal line 8 to holding capacitor 6 to hold the voltage.

The control voltage held in holding capacitor 6 is applied to the gate electrode of TFT 5, causing TFT 5 to convert the drive voltage constantly applied to power supply line 3 to the drive current corresponding to the voltage at the gate to be supplied to organic EL element 2. This operation continues even after switching element 7 has been turned off with the control signal applied to control line 9.

The drive current which is converted by TFT 5 from the drive voltage to be applied to power supply line 3 and supplied to organic EL element 2 corresponds to the voltage to be applied from holding capacitor 6 to the gate electrode of TFT 5. Therefore, organic EL element 2 may emit light at brightness corresponding to the control voltage supplied on signal line 8.

The aforementioned element driving device 1 is intended to be utilized actually as an image display device. In such a case, (m×n) organic EL elements 2 are arranged in m rows and n columns, m signal lines 8 and n control lines 9 are applied with the control voltage and the control signal respectively in matrix form, to make (m×n) holding capacitors 6 to individually hold the control voltages.

This causes (m×n) TFTs 5 to apply to each of (m×n) organic EL elements 2 as the drive current corresponding to the voltage held in each of (m×n) holding capacitors 6. As a result, organic EL elements 2 are allowed to emit light at individually different brightness, thus displaying an image in dot matrix form with gradation in pixel unit.

In element driving device 1, TFT 5 can generate the drive current to be supplied variably to organic EL elements 2 from the drive voltage to be supplied to power supply line 3. The drive current to be generated by TFT 5 from the drive voltage can be controlled with the voltage held in holding capacitor 6 which in turn can be controlled with the control voltage supplied to control line 8.

However, when the aforementioned image display device is manufactured actually using element driving device 1, each of m signal lines 8 may be connected to n of (m×n) organic EL elements 2. In connecting signal lines 8 of microstructure to a number of organic EL elements 2 to configure a high-definition image display device, the drive voltage to be supplied to organic EL element 2 would be varied due to a voltage drop on signal line 8.

Also, even if holding capacitor 6 is made to hold a desired control voltage to supply the drive voltage, the drive current supplied to organic EL element 2 will not correspond to the control voltage because the operational characteristics of multiple TFTs 5 of microstructure are not constant due to a manufacturing error. In this case, organic EL elements 2 in element driving device 1 are unable to emit light at the desired brightness, which results in deterioration of the quality of a displayed image with gradation obtained by an image display device using element driving device 1.

SUMMARY OF THE INVENTION

It is an object of the present invention to provide an element driving device capable of controlling the operation of active elements such as an organic EL element at a desired state.

It is another object of the present invention to provide an image display device capable of favorably displaying an image with multi-level gradation by the used a number of the active elements.

According to one aspect of the present invention, there is provided an element driving device which includes a first and second switching means and a voltage holding means. When the first and second switching means are turned on with a control signal applied to a control electrode, a control current applied from a signal electrode through the second switching means is converted to a control voltage through a conversion transistor, which is held in the voltage holding means through the first switching means.

A drive transistor converts a drive voltage to be applied to a power supply electrode into a drive current, in correspondence to the control voltage held in the voltage holding means and then applied to a gate electrode, so that the operation of an active element supplied with the drive current is controlled in correspondence with the control current applied to the signal electrode. This operation continues through the voltage holding of the voltage holding means after the first and second switching means have been turned off.

For controlling the operation of an active element, the signal electrode is applied not with the control voltage, but with the control current. Therefore even in a structure in which multiple active elements may be connected to one signal electrode, no operational difference occurs in active elements due to a voltage drop.

The drive transistor and a conversion transistor make up a current mirror circuit. For this reason, even when the drive transistor does not exhibit a desired operational characteristic due to a manufacturing error thereof, the drive current converted from the drive voltage through the drive transistor corresponds to the control current supplied to the conversion transistor if the conversion transistor has equivalently varied operational characteristics due to a similar manufacturing error, so that the active element will be supplied with the drive current corresponding to the control current on the signal electrode.

The signal electrode is applied with the control current, not with the control voltage, for controlling the operation of the active element, so that even in a structure in which multiple active elements are connected to one signal electrode, an operational difference in active elements due to a voltage drop can be prevented. Since the drive current corresponding to the control current on the signal electrode can be supplied to the active element, the active element can be controlled at a desired state.

According to another aspect of the present invention, there is provided an element driving device which includes a first and second switching means and a voltage holding means. When the first and second switching means are turned on m by m with a control signal to be applied in turn to n control electrodes, n control currents applied in turn from m signal electrodes through the (m×n) second switching means to be turned on m by m are converted in turn into (m×n) control voltages through (m×n) conversion transistors. These (m×n) control voltages are held in turn in (m×n) voltage holding means through the (m×n) first switching means to be turned on m by m.

(m×n) drive transistors individually convert a drive voltage to be applied to a power supply electrode into drive currents, in correspondence to the control voltages individually held in the (m×n) voltage holding means, so that (m×n) active elements individually supplied with these (m×n) drive currents are controlled at correspondence to the control currents applied to the signal electrodes. This operation continues through the voltage holding of the voltage holding means after the first and second switching means have been turned off.

The m signal electrodes are applied with the control current, not with the control voltage, for controlling the operation of the (m×n) active elements, so that even in a structure in which n of multiple (m×n) active elements are connected to each of m signal electrodes, no operational difference occurs in (m×n) active elements due to a voltage drop.

The drive transistor and the conversion transistor make up a current mirror circuit. Therefore, even when the drive transistor does not exert a desired operational characteristic due to a manufacturing error, the drive current converted from the drive voltage through the drive transistor corresponds to the control current supplied to the conversion transistor if the conversion transistor has equivalently varied operational characteristics due to a similar manufacturing error, and the active element can be supplied with the drive current corresponding to the control current on the signal electrode.

The signal electrode is applied with the control current, not with the control voltage, for controlling the operation of the active element, so that an operational difference in multiple active elements due to a voltage drop on the signal electrode can be prevented. The drive current corresponding to the control current on the signal electrode can be supplied to the active element, so that the active element can be controlled at a desired state.

In the aforementioned element driving device, the conversion transistor needs only to convert the control voltage into the control current. Therefore, the conversion transistor can be also replaced with a resistance element to simplify the structure.

In this case, the resistance element and the drive transistor do not make up a current mirror circuit. Therefore, the accuracy of correspondence is reduced between the control current supplied from the signal electrode to the resistance element and the drive current converted from the drive voltage by the drive transistor. Nevertheless, the active element can be supplied with the drive current corresponding to the control current on the signal electrode and the drive current is not affected by a voltage drop when the signal electrode is applied with the control voltage.

Also, in the aforementioned element driving device, the conversion transistor forming a current mirror circuit together with the drive transistor can be applied with the control voltage, not with the control current, from the signal electrode. In this case, the control voltage to be applied from the signal electrode to the conversion transistor is applied to the conversion transistor as a control current with its own electrical resistance, so that it is converted to the control voltage and held in the voltage holding means.

Despite a voltage drop in the control voltage on the signal electrode, a variation in the drive current due to a manufacturing error in the drive transistor and the conversion transistor is prevented, because the drive transistor and the conversion transistor make up a current mirror circuit.

In the aforementioned element driving device, the active element may be configured in the form of an organic EL element. In case, the organic EL element serving as an active element emits light at brightness corresponding to the control current applied to the signal electrode. Therefore, the organic EL element is allowed to emit light at desired brightness.

In the aforementioned element driving device, each of the drive transistor and the conversion transistor may be a TFT and the TFTs of the drive transistor and the conversion transistor may be formed at positions close to each other on one circuit board. In this case, operational characteristics of the drive transistor and the conversion transistor are equivalently varied due to similar manufacturing errors.

Accordingly, the drive current converted from the drive voltage through the drive transistor may correspond to the control current supplied to the conversion transistor, and the active element can be supplied with the drive current corresponding to the control current on the signal electrode. The active element can thus be accurately controlled at a desired state.

Also, in the aforementioned element driving device, the drive transistor may be connected in series to a first resistance element and the conversion transistor may be connected in series to a second resistance element. In this case, a ratio of a current change to a voltage variation in the drive transistor is reduced by the first resistance element connected thereto in series, and a ratio of a change in current for driving the active element to a variation in the drive voltage to be applied to the power supply electrode is reduced.

Since the second resistance element is connected to the conversion transistor similarly to the first resistance element. Operation as a current mirror circuit of the drive transistor and the conversion transistor may be favorable, so that the active element can be accurately controlled at a desired state.

In the aforementioned element driving device, each of the first and second resistance elements may be configured as a TFT having its drain electrode and its gate electrode short-circuited. In this case, the TFTs of the first and second resistance elements function as the resistance elements. For example, when each of the drive transistor and the conversion transistor also configured as a TFT, the TFTs of these transistors can be manufactured with the same processes as those of the TFTs of the first and second resistance elements. Productivity of the element driving device can thus be improved.

Also, in the aforementioned element driving device, the TFTs of the first resistance element and the second resistance element may be formed at positions close to each other on one circuit board. In this case, resistance characteristics of the first and second resistance elements are equally varied due to similar manufacturing errors. Therefore, operation as a current mirror circuit of the drive transistor and the-conversion transistor is favorable.

In the aforementioned element driving device, each of the first and second switching means may be configured as a TFT. In this case, when each of the drive transistor, the conversion transistor, and the first and second resistance elements is configured as a TFT, the TFTs thereof can be manufactured with the same processes as those of the TFTs of the first and second switching means. Productivity of the element driving device can thus be improved.

According to a still another aspect of the present invention, there is provided an image display device having the element driving devices according to the present invention and (m×n) active elements comprising display elements arranged in m rows and n columns. Therefore, in the image display device according to the present invention, the (m×n) active elements including the display elements arranged in m rows and n columns are driven in individually different display states by the element driving devices according to the present invention.

In the element driving device according to the present invention, the drive current satisfactorily corresponding to the control current on the signal electrode is supplied to the active element, so that the image display device according to the present invention performs display operation with pixels having individually proper gradation levels. Therefore, an image in dot matrix which represents gradation in pixel unit can be displayed with favorable quality.

According to a still another aspect of the present invention, there is provided an image display device with display elements comprising (m×n) active elements arranged in m rows and n columns in the element driving devices according to the present invention. In the image display device according to the present invention, the (m×n) active elements in the element driving devices according to the present invention are driven in individually different display states as the display elements arranged in m rows and n columns.

In the element driving device according to the present invention, the drive current satisfactorily corresponding to the control current on the signal electrode is supplied to the active element, so that the image display device according to the present invention performs display operation with pixels having individually proper gradation levels. Therefore, an image in dot matrix which represents gradation in pixel unit can be displayed with favorable quality.

The above and other objects, features and advantages according to the present invention will be apparent from the following description with reference to the accompanying drawings which illustrate examples of the present invention.

DETAILED DESCRIPTION OF THE PREFERRED EMBODIMENTS

A first embodiment according to the present invention will be hereinafter described with reference to FIG. 2 and FIG. 3.

Figure 1:
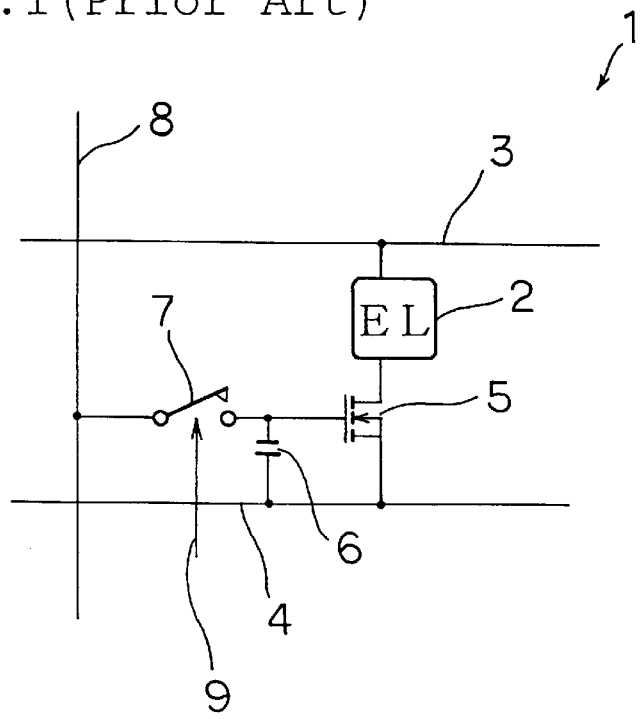
Fig.1(Prior Art)
FIG. 1 is a circuit diagram showing an element driving device of one prior art.
Figure 2:
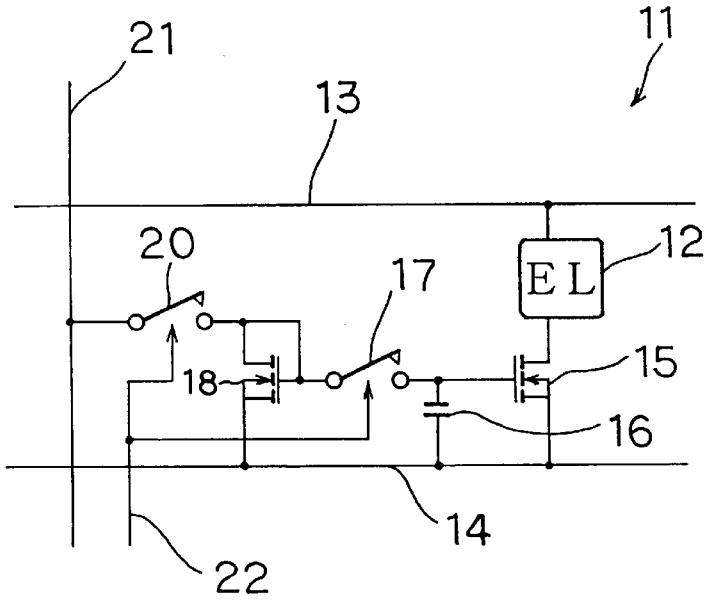
FIG. 2 is a circuit diagram showing an element driving device in a first embodiment according to the present invention.

Referring now to FIG. 2, there is shown an element driving device (EDD) 11 in the first embodiment according to the present invention. An element driving device (EDD) 11 has an organic EL element 12 as an active element and a power supply line 13 and a ground line 14 as a pair of power supply electrodes, similarly to element driving device 1 of the prior art shown. Power supply line 13 is applied with a predetermined drive voltage and ground line 14 is grounded.

Organic EL element 12 is connected directly to power supply line 13 and connected to ground line 14 through drive TFT 15 in the form of an n-channel MOS (Metal Oxide Semiconductor) FET (Field Effect Transistor) made of polysilicon.

Drive TFT 15 converts the drive voltage to be applied from power supply line 13 to ground line 14 into a drive current corresponding to a control voltage to be applied to a gate electrode and supplies the current to organic EL element 12.

The gate electrode of drive TFT 15 is connected to holding capacitor 16 for holding the voltage, which is also connected to ground line 14. Holding capacitor 16 and the gate electrode of drive TFT 15 are connected to one end of first switching element 17.

Unlike element driving device 1 of the prior art shown, the other terminal of first switching element 17 is connected to conversion TFT 18 which serves as a current converting element. Conversion TFT 18, as shown in FIG. 3, has the same structure as that of drive TFT 15 and is formed at a position close to drive TFT 15 on one circuit board 19.

Conversion TFT 18 is also connected to ground line 14 similarly to drive TFT 15. These TFTs 15, 18 make up a current mirror circuit through first switching element 17. Conversion TFT 18 is connected to signal line 21 serving as a signal electrode through second switching element 20. A control terminal of second switching element 20 is connected to control line 22 serving as a control electrode similarly to first switching element 17.

Figure 3:
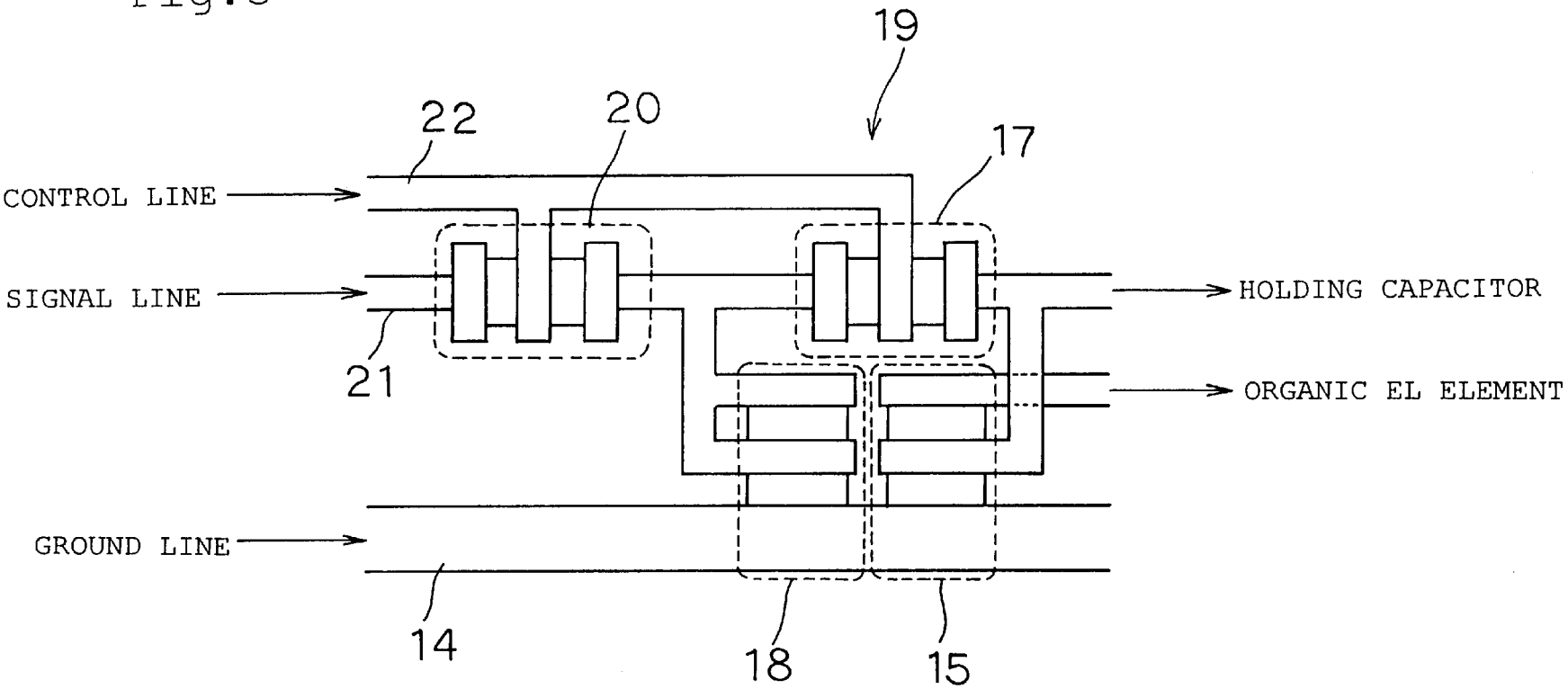
FIG. 3 is a plan view showing a thin-film structure of main units of the element driving device of the first embodiment.

As shown in FIG. 3, each of first and second switching elements 17, 20 also have a TFT of the similar structure to that of drive/conversion TFTs 15, 18, and formed at positions close to each other on circuit board 19.

In element driving device 11 according to this embodiment, unlike element driving device 1 of the prior art, a control signal for controlling the emission brightness of organic EL element 12 is supplied to signal line 21 as a variable control current, not as a variable control voltage. Control line 22 is applied with a control signal for controlling the operation of first switching element 17 and second switching element 20.

Second switching element 20 turns on and off the connection between signal line 21 and conversion TFT 18. First switching element 17 turns on and off the connection between conversion TFT 18 and holding capacitor 16. Conversion TFT 18 converts the control current applied from signal line 21 through second switching element 20 into the control voltage. Holding capacitor 16 holds the control voltage to be applied from conversion TFT 18 through first switching element 17 to apply the voltage to the gate electrode of drive TFT 15.

Figure 4:
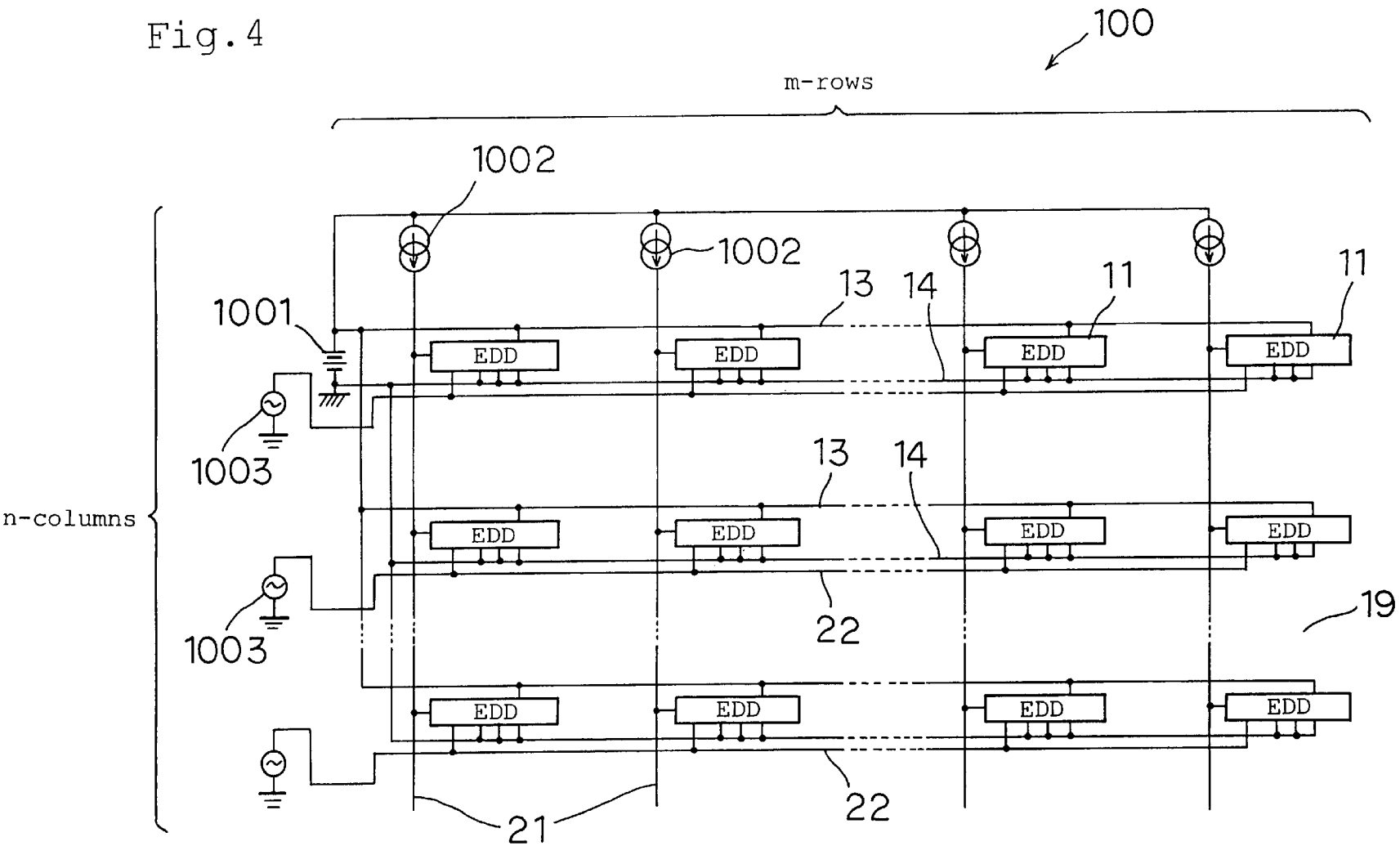
FIG. 4 is a block diagram showing an image display device in the first embodiment according to the present invention.

Element driving device 11 according to this embodiment also constitutes actually a unit of image display device 1000 as shown in FIG. 4. In image display device 1000 in this embodiment, (m×n) organic EL elements 12 are arranged in m rows and n columns on circuit board 19.

M signal lines 21 are connected to one another to form collectively one set connected to one direct-current power supply 1001. M ground lines 14 are connected to one another to form collectively one set connected to a large capacity component such as a housing (not shown) i.e., grounded.

Each of m signal lines 21 is connected individually to each of m current drivers 1002 for generating a control current. Each of n control lines 22 is connected individually to each of n signal drivers 1003 for generating a control signal. All of drivers 1002, 1003 are connected to one integration control circuit (not shown), which controls the matrix drive of m current drives 1002 and n signal drivers 1003.

Figure 5:
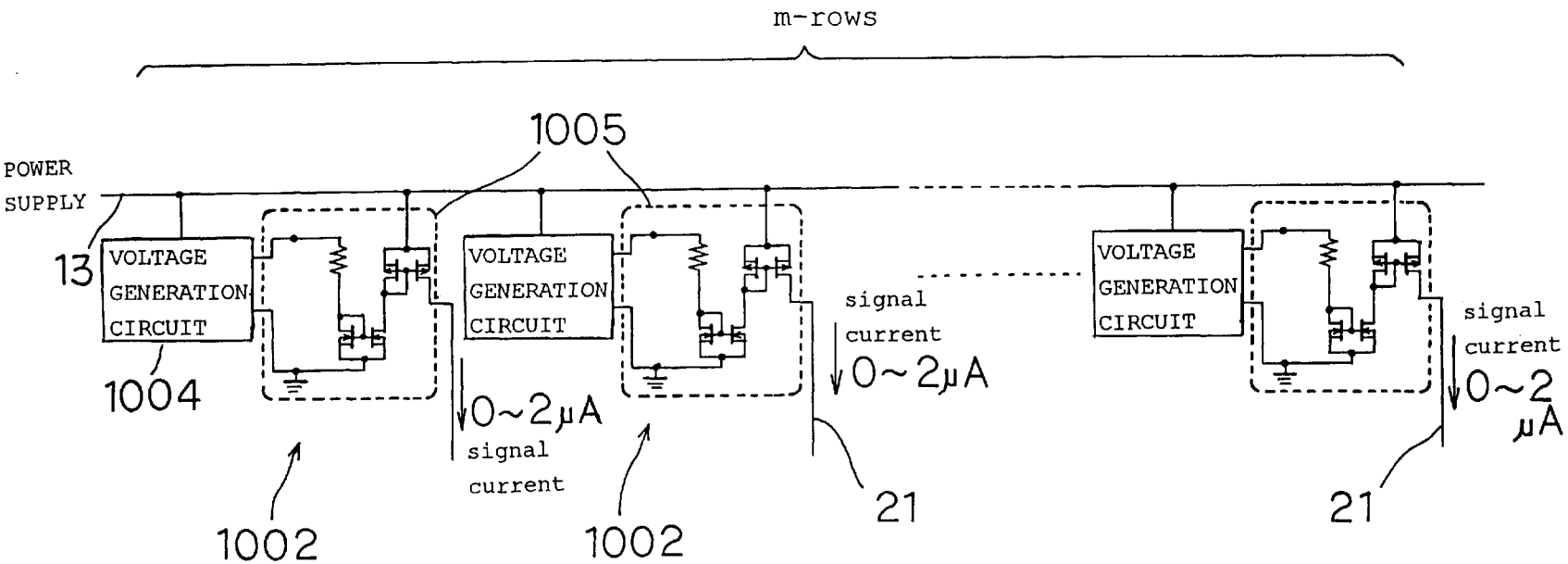
FIG. 5 is a circuit diagram showing a unit of a current driver of the image display device.

Each of m current drivers 1002 includes a voltage generation circuit 1004 and a current conversion circuit 1005 as shown in FIG. 5, which are connected to each other. Each of m voltage generation circuits 1004 is connected to one direct-current power supply 1001 and the one integration control circuit. Each of m current conversion circuit 1005 is connected to each of m signal lines 21.

Each of voltage generation circuit 1004 generates in turn voltages corresponding to the brightness of n organic EL elements 12 in each row from a constant-voltage generated by direct-current power supply 1001 under the control of the integration control circuit. Each of current conversion circuits 1005 converts the voltage generated by voltage generation circuit 1004 to a signal current ranging from "0 to 2 ($\mu$A)" to output the current to each of m signal lines 21.

In the configuration as described above, element driving device 11 in this embodiment, similarly to element driving device 1 of one prior art, can control organic EL element 12 with variable emission brightness. In this case, the control signal is applied to control line 22 to turn on first and second switching elements 17, 20, and with this state, signal line 21 is applied with the control current corresponding to the emission brightness of organic EL element 12.

The control current is then applied to conversion TFT 18 through second switching element 20 and converted to the control voltage. The control voltage is held in holding capacitor 16 through first switching element 17. The voltage held in holding capacitor 16 is applied to the gate electrode of drive TFT 15. Accordingly, the drive voltage constantly applied to power supply line 13 is converted to the drive current through drive TFT 15 and supplied to organic EL element 12.

The amount of the drive current corresponds to the voltage to be applied to the gate electrode of drive TFT 15 from holding capacitor 16. Organic EL element 12 can thus emit light at brightness corresponding to the control current supplied to signal line 21. This operation is maintained by the voltage held in holding capacitor 16 even after first and second switching elements 17, 20 have been turned off.

In image display device 1000 which utilizes element driving device 11 in this embodiment, (m×n) organic EL elements 12 arranged in matrix form emit light at individually controlled brightness. An image can thus be displayed in dot matrix which represents gradation in pixel unit.

In element driving device 11 according to this embodiment, the control signal for controlling the emission brightness of organic EL element 12 is applied to signal line 21 as the control current, not as the control voltage as discussed above. For this reason, even with a structure in which a number of organic EL elements 12 are connected to signal line 21 of microstructure for forming a high-definition image display device 1000, no difference occurs in the current for driving organic EL elements 12 due to a voltage drop applied to signal line 21.

In element driving device 11 according to this embodiment, drive TFT 15 and conversion TFT 18 make up a current mirror circuit. Therefore, even if drive TFT 15 fails to exhibit a desired operational characteristic due to a manufacturing error, the drive current to be converted from the drive voltage by drive TFT 15 corresponds to the control current to be supplied to conversion TFT 18 if the operational characteristic of conversion TFT 18 is equivalently varied due to a similar manufacturing error.

In element driving device 11 according to this embodiment, it is possible to supply the drive current exactly corresponding to the control current conducted through signal line 21 to organic EL element 12. Therefore, image display device 1000 utilizing element driving device 11 according to this embodiment can display an image having gradation represented in pixel unit with good quality.

In particular, in element driving device 11 according to this embodiment, as shown in FIG. 3, drive/conversion TFTs 15 and 18 which make up a current mirror circuit are formed at positions close to each other on circuit board 19. So that, drive/conversion TFTs 15, 18 can exhibit equivalent operational characteristics with similar manufacturing errors.

In element driving device 11 according to this embodiment, first and second switching elements 17, 20 are also configured as TFTs, so that first and second switching elements 17, 20 can be manufactured on the same processes as those of drive/conversion TFTs 15, 18. This eliminates incidentally dedicated processes for forming first and second switching elements 17, 20, thus improving productivity.

Although, the present embodiment has been described as an example utilizing organic EL element 12 as an active element, the present invention is also applicable to various active elements such as an LED (Light Emitting Diode) and an LD (Laser Diode) which are controlled with a variable drive current.

In addition, although the present embodiment has been shown as an example in which element driving devices 11 are arranged in matrix form to form image display device 1000, it is also possible to arrange the element driving devices in a line to form a line head of an electro-photograph device.

Also, although the present embodiment has been shown as an example in which element driving device 11 of microstructure is formed by use of a thin-film technology, the element driving device can also be assembled with a chip component in order to realize a very large image display device.

Additionally, although the present embodiment has been shown as an example in which element driving device 11 includes organic EL element 12 which is an active element as a portion thereof, it is also possible to form a display panel having active elements arranged thereon and a circuit panel which includes an element driving device separately and then bond them together.

Figure 6:
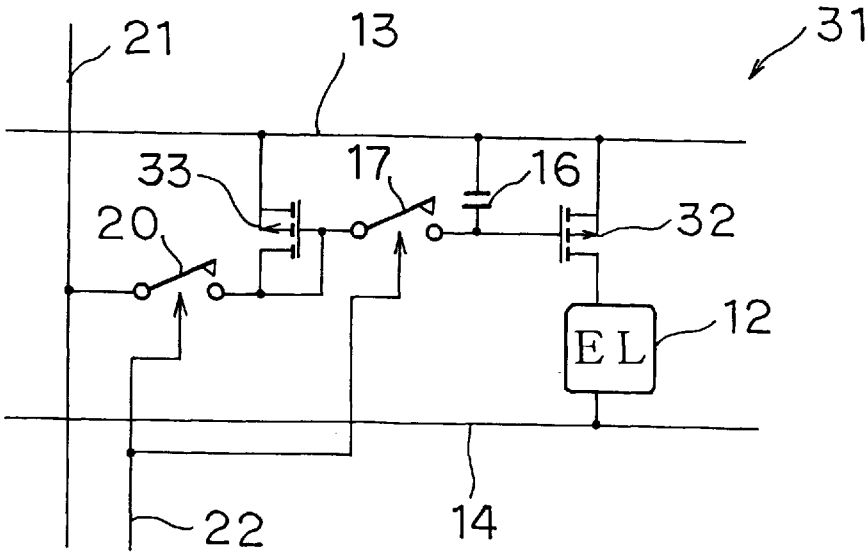
FIG. 6 is a circuit diagram showing an element driving device of a first variation.

Further, the present embodiment has been shown as an example in which drive/conversion TFTs 15, 18 are of n-channel structure and drive TFT 15 is formed in-between organic EL element 12 and ground line 14, it is also possible that drive/conversion TFTs 32, 33 are of p-channel structure and drive TFT 32 is formed in-between organic EL element 12 and power supply line 13, as with element driving device 31 illustrated in FIG. 6 as a first variation.

However, since TFTs 15, 18 of n-channel structure have a substantially half occupied area as compared with TFTs 32, 33 of p-channel structure, TFTs 15, 18 of n-channel structure may preferably be employed to obtain a smaller and lighter device and a larger area available for organic EL element 12.

Figure 7:
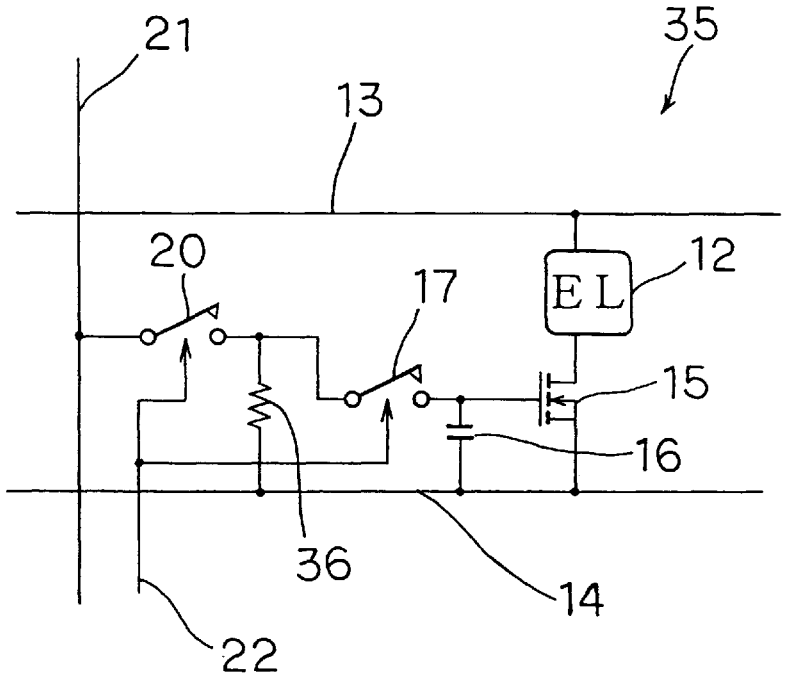
FIG. 7 is a circuit diagram showing an element driving device of a second variation.

Also, although the present embodiment has been shown as an example in which it includes conversion TFT 18 which serves as a current conversion element for converting the control current to the control voltage, it is also possible to utilize resistance element 36 as the current conversion element, as with element driving device 35 illustrated in FIG. 7 as a second variation.

In this case, since resistance element 36 and drive TFT 15 do not make up a current mirror circuit, the accuracy of correspondence between the control current and the drive current is lowered. Nevertheless, signal line 21 is supplied with the control current, not with the control voltage, so that a difference in emission brightness of organic EL elements 12 due to a voltage drop can be prevented.

Additionally, the present embodiment has been shown as an example in which signal line 21 is supplied with the control current, not with the control voltage, if the control current is replaced with the control voltage, conversion/drive TFTs 15, 18 make up a current mirror circuit, so that the control voltage and the drive current can be made satisfactorily correspond to each other.

In this case, the control voltage is applied to conversion TFT 18 as the control current with its own electrical resistance. This control current is converted to the control voltage by conversion TFT 18. Since conversion TFT 18 has an MOS resistance with a very small manufacturing error, a difference in the control current due to the manufacturing error of conversion TFT 18 is very small.

Furthermore, although the present embodiment has been shown as an example in which holding capacitor 16 made of a single component as a member for holding the voltage and applying the voltage to the gate electrode of drive TFT 15, the gate electrode of drive TFT 15 may also hold the voltage with its own capacitance.

Figure 8:
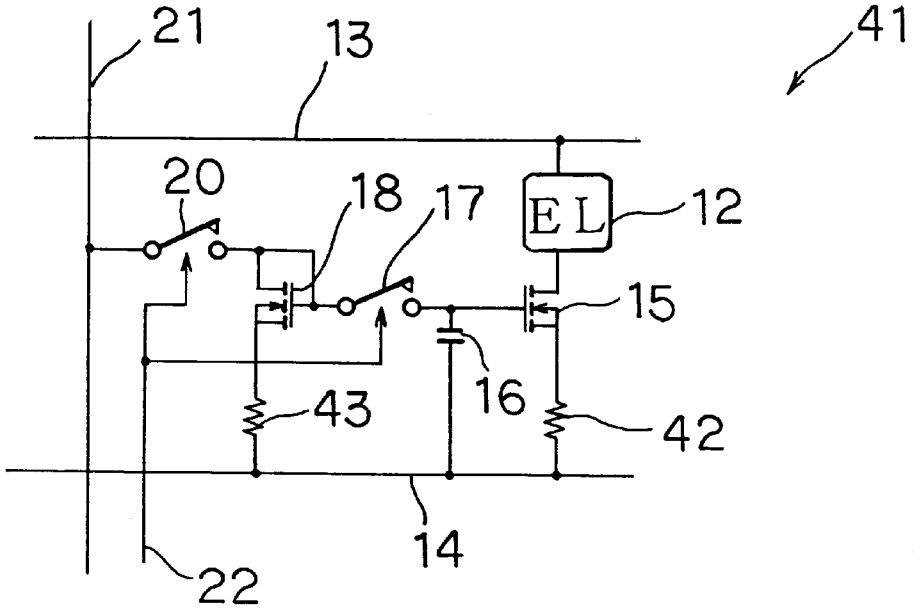
FIG. 8 is a circuit diagram showing an element driving device of a second embodiment according to the present invention.

Next, a second embodiment according to the present invention will be described with reference to FIG. 8.

In this second embodiment, components identical to those of the first embodiment are designated with the same name and reference symbols and numerals, and detailed descriptions thereof are omitted.

In element driving device 41 according to this embodiment, drive TFT 15 is connected in series to a first resistance element 42 and conversion TFT 18 is connected in series to second resistance element 43. The first and second resistance elements 42, 43 may be made of, for example, a conductive thin-film, and have the same resistance value.

In the configuration as described above, element driving device 41 according to this embodiment functions similarly to element driving device 11 of the first embodiment. However, since in element driving device 41 according to this embodiment, drive TFT 15 is connected in series to first resistance element 42, a ratio of a current change to a voltage change in drive TFT 15 is reduced by means of first resistance element 42.

In element driving device 41 according to this embodiment, a change in current for driving organic EL element 12 is thus reduced compared to a variation in drive voltage to be applied to power supply line 13. Therefore, organic EL element 12 is caused to favorably emit light at desired brightness, thus improving display quality when an image display device is formed.

In element driving device 41, if first and second resistance elements 42, 43 are formed at positions close to each other on circuit board 19, a variation in resistance characteristics due to a manufacturing error of first and second resistance elements 42, 43 can be made equal to each other. Therefore, characteristic correction for drive/conversion TFTs 15, 18 by first and second resistance elements 42, 43 can be made equal to each other, and the current mirror circuit can thus be favorably operated.

Figure 9:
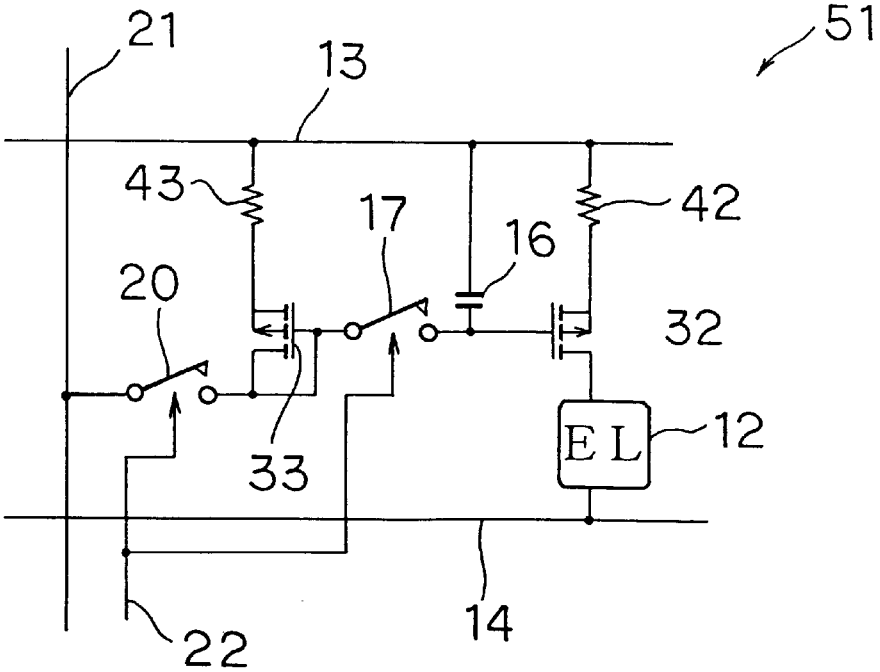
FIG. 9 is a circuit diagram showing an element driving device of a third variation.

As shown in FIG. 9, element driving device 51 can be of course implemented such that the first and second resistance elements 42, 43 are connected to p-channel drive/conversion TFTs 32, 33, respectively.

Figure 10:
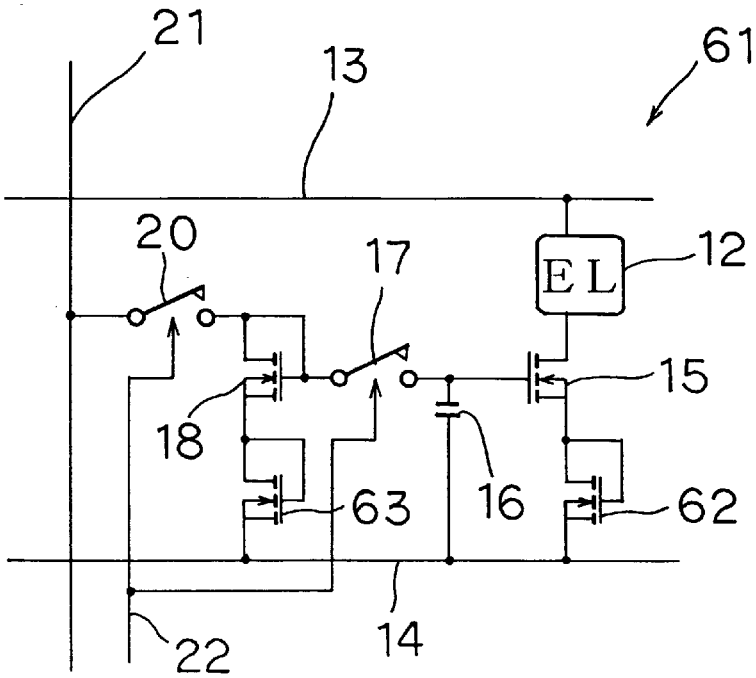
FIG. 10 is a circuit diagram showing an element driving device of a fourth variation.

Also, as with element driving device 61 shown in FIG. 10, first and second resistance elements 62, 63 may be configured as TFTs each having its drain electrode and its gate electrode short-circuited. In this case, each of these TFTs functions as a resistance element, so that element driving device 61 can function similarly to the element driving device 41.

Additionally, since first and second resistance elements 62, 63 configured as TFTs may be formed on the same processes as those of drive/conversion TFTs 15, 18, element driving device 61 has an improved productivity.

If the TFTs of first and second resistance elements 62, 63 are also formed at positions close to each other on circuit board 19, a variation in resistance characteristics thereof due to a manufacturing error can be made equal to each other, so that a current mirror circuit consisting of drive/conversion TFTs 15, 18 can be operated satisfactorily.

Figure 11:
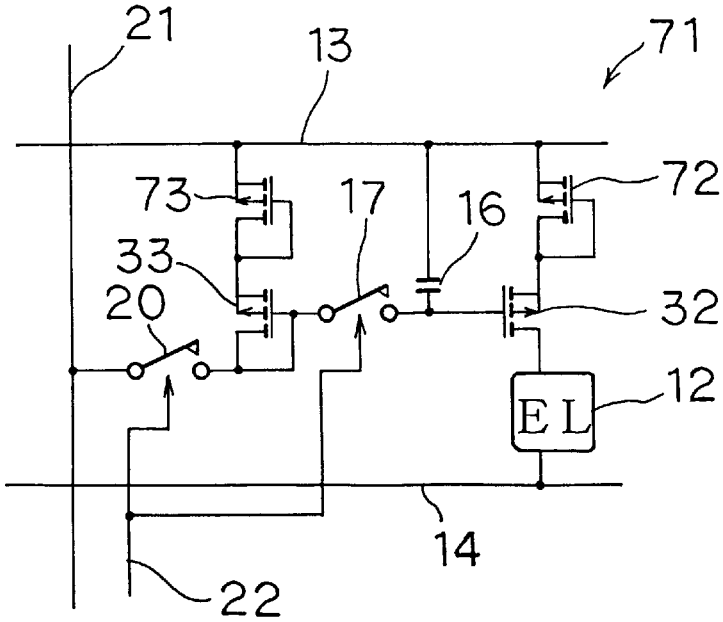
FIG. 11 is a circuit diagram showing an element driving device of a fifth variation.

As with element driving device 71 shown in FIG. 11, p-channel drive/conversion TFTs 32, 33 may be connected to first and second resistance elements 72, 73 comprising p-channel TFTs.

Figure 12:
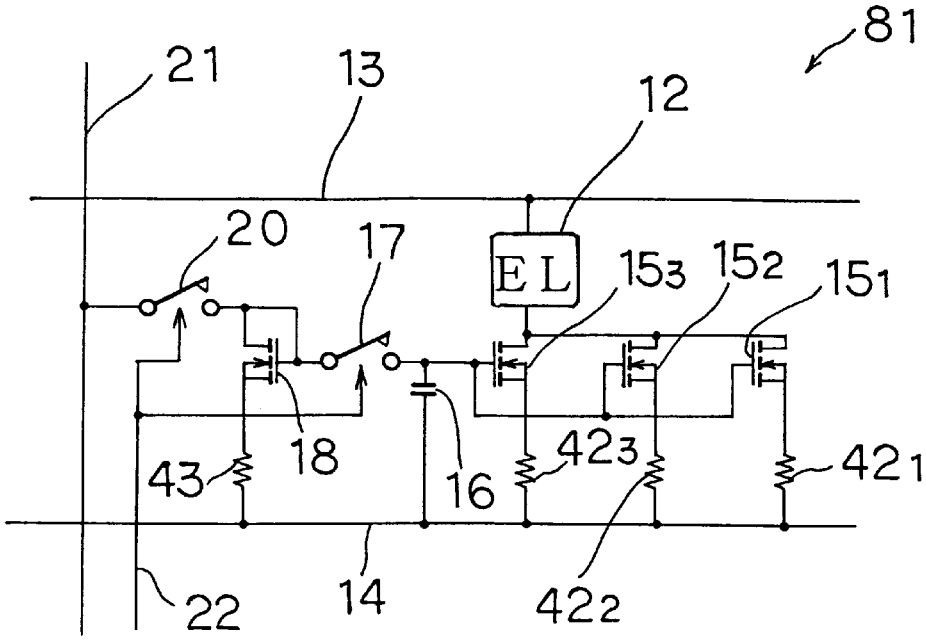
FIG. 12 is a circuit diagram showing an element driving device of a sixth variation.

Also, as with element driving device 81 shown in FIG. 12, a drive transistor can comprise a plurality of TFTs 15, to $\mathbf{15}_3$ connected in parallel, each of which being connected to a corresponding one of a plurality of first resistance elements $\mathbf{42}_1$ to $\mathbf{42}_3$. In this case, drive TFTs $\mathbf{15}_1$ to $\mathbf{15}_3$ and conversion TFT 18 functioning as a current mirror circuit have a ratio of a conducting current "3:1". Therefore, a high drive current can be supplied to organic EL element 12 even with a very low control current.

Although description herein is made, assuming that the drive transistor includes the plurality of TFTs 15, to $\mathbf{15}_3$ connected in parallel for simplifying the description, they represent an equivalent circuit. Therefore, the plurality of TFTs $\mathbf{15}_1$ to $\mathbf{15}_3$ can be actually formed as one TFT which has an area three times larger than that of conversion TFT 18, and similarly, resistance elements $\mathbf{42}_1$ to $\mathbf{42}_3$ may be formed as one resistance element.

Figure 13:
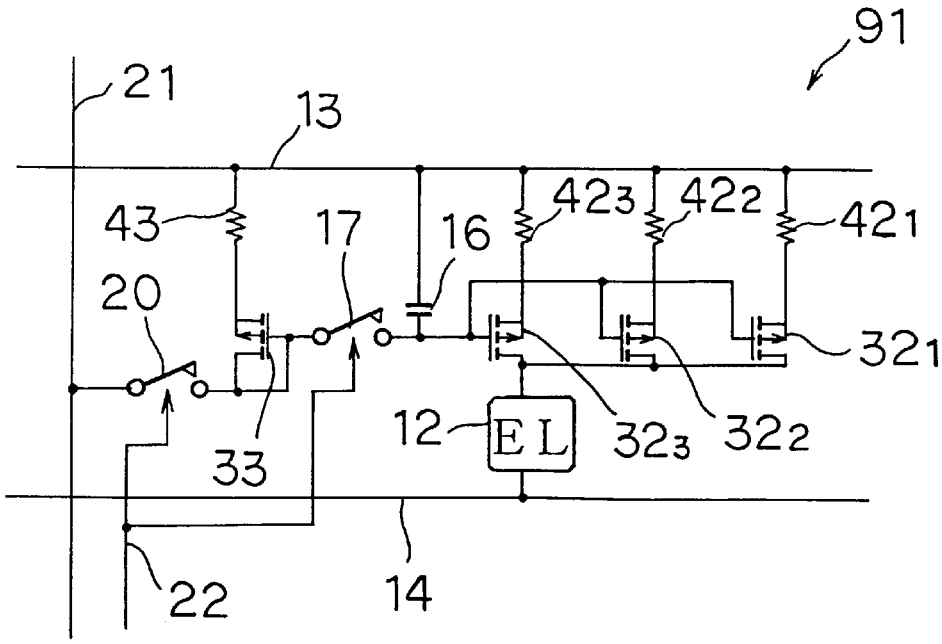
FIG. 13 is a circuit diagram showing an element driving device of a seventh variation.

Although, the first and second resistance elements can be omitted in a structure in which the current ratio in the current mirror circuit is set as described above. As with element driving device 91 shown in FIG. 13, the current ratio in the current mirror can be set with p-channel drive/conversion TFTs $\mathbf{32}_1$ to $\mathbf{32}_3$, and 33.

Figure 14:
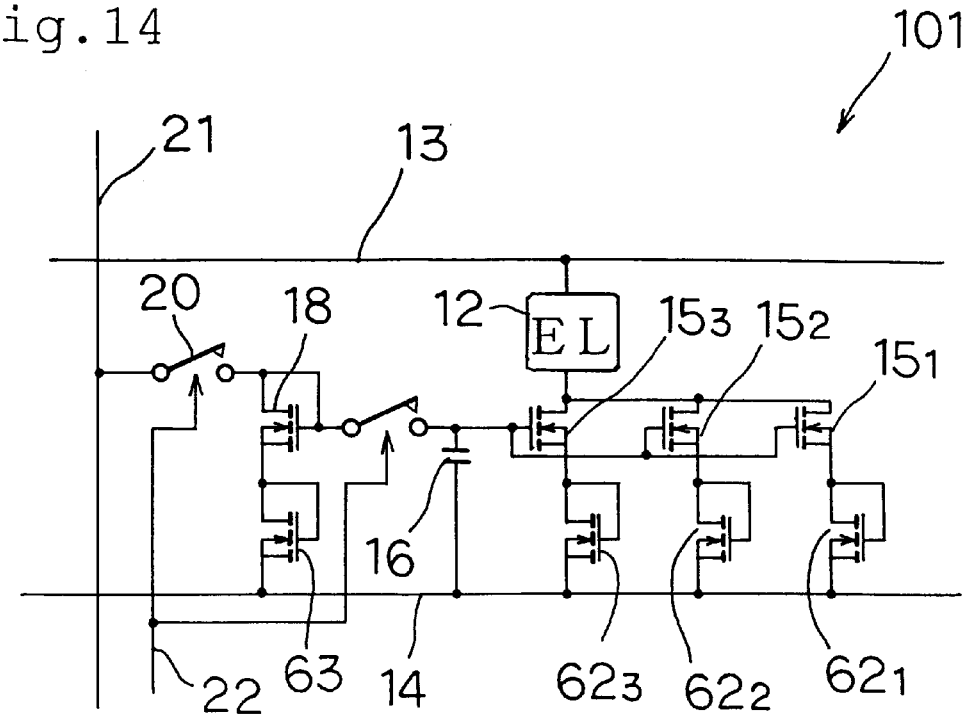
FIG. 14 is a circuit diagram showing an element driving device of an eighth variation.

Additionally, as element driving device 101 shown in FIG. 14, first and second resistance elements $\mathbf{62}_1$ to $\mathbf{62}_3$, and 63 may be formed of TFTs in a structure in which a current ratio in a current mirror circuit is set.

Figure 15:
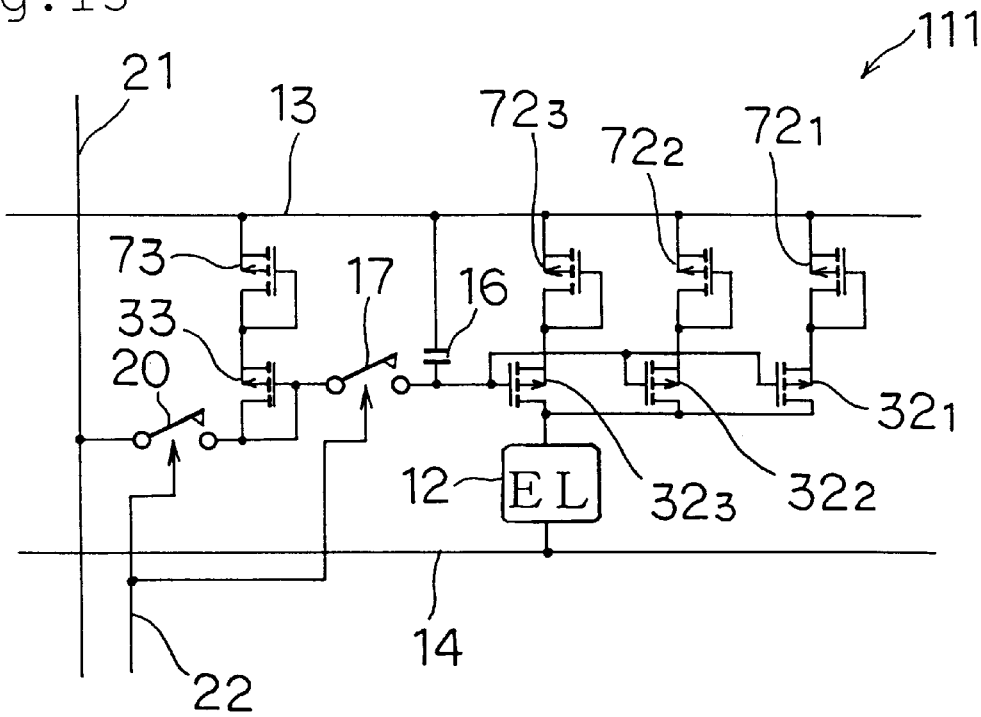
FIG. 15 is a circuit diagram showing an element driving device of a ninth variation.

As with element driving device 111 shown in FIG. 15, first and second resistance elements $\mathbf{72}_1$ to $\mathbf{72}_3$, and 73 may be formed of p-channel TFTs in a structure in which a current ratio in a current mirror circuit is set.

While preferred embodiments according to the present invention have been described using specific terms, such description is for illustrative purposes only, and it is to be understood that changes and variations may be made without departing from the spirit or scope of the following claims.

What is claimed is:

1. An element driving device for driving an active element with a variable drive current comprising:

a power supply electrode applied with a predetermined drive voltage;

a drive transistor for converting a drive voltage to be applied to said power supply electrode into a drive current corresponding to a control voltage to be applied to a gate electrode and supplying said active element with the drive current;

a signal electrode supplied with a control current for driving said active element;

a current conversion element for converting the control current to be supplied to said signal electrode into the control voltage;

voltage holding means for holding the control voltage converted by said current conversion element and applying the control voltage to the gate electrode of said drive transistor;

a control electrode applied with a control signal for controlling the operation of the voltage holding of said voltage holding means;

first switching means for turning on and off a connection between said voltage holding means and said current conversion element in response to a control signal applied to said control electrode; and second switching means for turning on and off a connection between said signal electrode and said current conversion element in response to said control signal applied to said control electrode.

2. The element driving device according to claim 1, wherein said current conversion element comprises a resistance element.

3. The element driving device according to claim 1, wherein said current conversion element comprises a conversion transistor which makes up a current mirror circuit in conjunction with said drive transistor.

4. The element driving device according to claim 3, wherein each of said drive transistor and-said conversion transistor comprises a TFT (Thin Film Transistor), wherein the TFTs of said drive transistor and said conversion transistor are formed at positions close to each other on one circuit board.

5. The element driving device according to claim 1, wherein said active element comprises an organic EL (Electro-Luminescence) element.

6. The element driving device according to claim 1, wherein said drive transistor is connected in series to a first resistance element, wherein said conversion transistor is connected in series to a second resistance element.

7. The element driving device according to claim 6, wherein each of said first and second resistance elements includes a TFT having a drain electrode and a gate electrode short-circuited.

8. The element driving device according to claim 7, wherein the TFTs of said first resistance element and said second resistance element are formed at positions close to each other on one circuit board.

9. The element driving device according to claim 1, wherein each of said first resistance element and said second resistance element includes a TFT.

10. An element driving device comprising:

an active element driven with a variable drive current;

a power supply electrode applied with a predetermined drive voltage;

a drive transistor for converting a drive voltage to be applied to said power supply electrode into a drive current corresponding to a control voltage to be applied to a gate electrode and supplying said active element with the drive current;

a signal electrode supplied with a control current for driving said active element;

a current conversion element for converting the control current to be supplied to said signal electrode into the control voltage;

voltage holding means for holding the control voltage converted by said current conversion element and applying the control voltage to the gate electrode of said drive transistor;

a control electrode applied with a control signal for controlling the operation of the voltage holding of said voltage holding means;

first switching means for turning on and off a connection between said voltage holding means and said current conversion element in response to a control signal applied to said control electrode; and second switching means for turning on and off a connection between said signal electrode and said current conversion element in response to said control signal applied to said control electrode.

11. An element driving device for individually driving (m×n: m and n are both natural numbers) active elements with a variable drive current comprising:

a power supply electrode applied with a predetermined drive voltage;

(m×n) drive transistors for individually converting the drive voltage to be applied to said power supply electrode into drive currents corresponding to control voltages applied to respective gate electrodes and individually supplying said (m×n) active elements with the drive currents;

m signal electrodes each supplied with n control currents in turn for individually driving said (m×n) active elements;

(m×n) current conversion elements for converting the n control currents supplied in turn to each of said m signal electrodes into the (m×n) control voltages;

(m×n) voltage holding means for individually holding the (m×n) control voltages converted by said (m×n) current conversion elements and applying the control voltages individually to the gate electrodes of said (m×n) drive transistors;

n control electrodes applied in turn with control signals for individually controlling the operation of the voltage holding of said (m×n) voltage holding means;

(m×n) first switching means for individually turning on and off connections between said (m×n) voltage holding means and said (m×n) current conversion elements in response to the m control signals applied to each of said n control electrodes; and (m×n) second switching means for individually turning on and off connections between said m signal electrodes and said (m×n) current conversion elements in response to the control signals applied to said n control electrodes.

12. An element driving device comprising:

(m×n) active elements driven with a variable drive current;

a power supply electrode applied with a predetermined drive voltage;

(m×n) drive transistors for individually converting the drive voltage to be applied to said power supply electrode into drive currents corresponding to control voltages applied to respective gate electrodes and individually supplying said (m×n) active elements with the drive currents;

m signal electrodes each supplied with n control currents in turn for individually driving said (m×n) active elements;

(m×n) current conversion elements for converting the n control currents supplied in turn to each of said m signal electrodes into the (m×n) control voltages;

(m×n) voltage holding means for individually holding the (m×n) control voltages converted by said (m×n) current conversion elements and applying the control voltages individually to the gate electrodes of said (m×n) drive transistors;

n control electrodes applied in turn with control signals for individually controlling the operation of the voltage holding of said (m×n) voltage holding means;

(m×n) first switching means for individually turning on and off connections between said (m×n) voltage holding means and said (m×n) current conversion elements in response to the m control signals applied to each of said n control electrodes; and (m×n) second switching means for individually turning on and off connections between said m signal electrodes and said (m×n) current conversion elements in response to the control signals applied to said n control electrodes.

13. An element driving device for driving an active element with a variable drive current comprising:

a power supply electrode applied with a predetermined drive voltage;

a drive transistor for converting a drive voltage to be applied to said power supply electrode into a drive current corresponding to a control voltage to be applied to a gate electrode and supplying said active element with the drive current;

a signal electrode supplied with a control voltage for driving said active element;

a conversion transistor having a structure which makes up a current mirror circuit in conjunction with said drive transistor, said conversion transistor being applied with the control voltage supplied to said signal electrode as a control current by its own electrical resistance to convert the current into the control voltage;

voltage holding means for holding the control voltage converted by said conversion transistor and applying the control voltage to the gate electrode of said drive transistor;

a control electrode applied with a control signal for controlling the operation of the voltage holding of said voltage holding means;

first switching means for turning on and off a connection between said voltage holding means and said conversion transistor in response to a control signal applied to said control electrode; and second switching means for turning on and off a connection between said signal electrode and said conversion transistor in response to said control signal applied to said control electrode.

14. The element driving device according to claim 13, wherein each of said drive transistor and said conversion transistor comprises a TFT, wherein the TFTs of said drive transistor and said conversion transistor are formed at positions close to each other on one circuit board.

15. The element driving device according to claim 13, wherein said drive transistor is connected in series to a first resistance element, wherein said conversion transistor is connected in series to a second resistance element.

16. The element driving device according to claim 15, wherein each of said first and second resistance elements includes a TFT having a drain electrode and a gate electrode short-circuited.

17. The element driving device according to claim 16, wherein the TFTs of said first resistance element and said second resistance element are formed at positions close to each other on one circuit board.

18. The element driving device according to claim 13, wherein each of said first resistance element and said second resistance element includes a TFT.

19. An element driving device comprising:

an active element driven with a variable drive current;

a power supply electrode applied with a predetermined drive voltage;

a drive transistor for converting a drive voltage to be applied to said power supply electrode into a drive current corresponding to a control voltage to be applied to a gate electrode and supplying said active element with the drive current;

a signal electrode supplied with a control voltage for driving said active element;

a conversion transistor having a structure which makes up a current mirror circuit in conjunction with said drive transistor, said conversion transistor being applied with the control voltage supplied to said signal electrode as a control current by its own electrical resistance to convert the current into the control voltage;

voltage holding means for holding the control voltage converted by said conversion transistor and applying the control voltage to the gate electrode of said drive transistor;

a control electrode applied with a control signal for controlling the operation of the voltage holding of said voltage holding means;

first switching means for turning on and off a connection between said voltage holding means and said conversion transistor in response to a control signal applied to said control electrode; and second switching means for turning on and off a connection between said signal electrode and said conversion transistor in response to said control signal applied to said control electrode.

20. The element driving device according to claim 19, wherein each of said drive transistor and said conversion transistor are formed at positions close to each other on one circuit board.

21. An element driving device for individually driving (m×n) active elements with a variable drive current comprising:

a power supply electrode applied with a predetermined drive voltage;

(m×n) drive transistors for individually converting the drive voltage to be applied to said power supply electrode into drive currents corresponding to control voltages applied to respective gate electrodes and individually supplying said (m×n) active elements with the drive currents;

m signal electrodes each supplied with n control voltages in turn for individually driving said (m×n) active elements;

(m×n) conversion transistors each having a structure which makes up a current mirror circuit in conjunction with each of said (m×n) drive transistors, said conversion transistors being applied with the n control voltages supplied in turn to each of said m signal electrodes as-n control currents by their own electrical resistance to convert the currents into the (m×n) control voltages;

(m×n) voltage holding means for individually holding the (m×n) control voltages converted by said (m×n) conversion transistors and applying the control voltages individually to the gate electrodes of said (m×n) drive transistors;

n control electrodes applied in turn with control signals for individually controlling the operation of the voltage holding of said (m×n) voltage holding means;

(m×n) first switching means for individually turning on and off connections between said (m×n) voltage holding means and said (m×n) conversion transistors in response to the m control signals applied to each of said n control electrodes; and (m×n) second switching means for individually turning on and off connections between said m signal electrodes and said (m×n) conversion transistors in response to the control signals applied to said n control electrodes.

22. The element driving device according to claim 21, wherein each of said drive transistor and said conversion transistor comprises a TFT, wherein the TFTs of said drive transistor and said conversion transistor are formed at positions close to each other on one circuit board.

23. An element driving device comprising:

(m×n) active elements driven with a variable drive current;

a power supply electrode applied with a predetermined drive voltage;

(m×n) drive transistors for individually converting the drive voltage to be applied to said power supply electrode into drive currents corresponding to control voltages applied to respective gate electrodes and individually supplying said (m×n) active elements with the drive currents;

m signal electrodes each supplied with n control voltage in turn for individually driving said (m×n) active elements;

(m×n) conversion transistors each having a structure which makes up a current mirror circuit in conjunction with each of said (m×n) drive transistors, said conversion transistors being applied with the n control voltages supplied in turn to each of said m signal electrodes as n control currents by their own electrical resistance to convert the currents into the (m×n) control voltages;

(m×n) voltage holding means for individually holding the (m×n) control voltages converted by said (m×n) conversion transistors and applying the control voltages individually to the gate electrodes of said (m×n) drive transistors;

n control electrodes applied in turn with control signals for individually controlling the operation of the voltage holding of said (m×n) voltage holding means;

(m×n) first switching means for individually turning on and off connections between said (m×n) voltage holding means and said (m×n) conversion transistors in response to the m control signals applied to each of said n control electrodes; and (m×n) second switching means for individually turning on and off connections between said m signal electrodes and said (m×n) conversion transistors in response to the control signals applied to said n control electrodes.

24. The element driving device according to claim 23, wherein each of said drive transistor and said conversion transistor comprises a TFT, wherein the TFTs of said drive transistor and said conversion transistor are formed at positions close to each other on one circuit board.

25. An image display device comprising:

(m×n) active elements comprising display elements arranged in m rows and n columns (m and n are both natural numbers);

a power supply electrode applied with a predetermined drive voltage;

(m×n) drive transistors for individually converting the drive voltage to be applied to said power supply electrode into drive currents corresponding to control voltages applied to respective gate electrodes and individually supplying said (m×n) active elements with the drive currents;

m signal electrodes each supplied with n control currents in turn for individually driving said (m×n) active elements;

(m×n) current conversion elements for converting the n control currents supplied in turn to each of said m signal electrodes into the (m×n) control voltages;

(m×n) voltage holding means for individually holding the (m×n) control voltages converted by said (m×n) current conversion elements and applying the control voltages individually to the gate electrodes of said (m×n) drive transistors;

n control electrodes applied in turn with control signals for individually controlling the operation of the voltage holding of said (m×n) voltage holding means;

(m×n) first switching means for individually turning on and off connections between said (m×n) voltage holding means and said (m×n) current conversion elements in response to the m control signals applied to each of said n control electrodes; and (m×n) second switching means for individually turning on and off connections between said m signal electrodes and said (m×n) current conversion elements in response to the control signals applied to said n control electrodes.

* * * * *